US011065677B2

(12) United States Patent
Salas-Loranca et al.

(10) Patent No.: US 11,065,677 B2
(45) Date of Patent: Jul. 20, 2021

(54) AUTOMATED ASSEMBLY CELL AND ASSEMBLY LINE FOR PRODUCING SAND MOLDS FOR FOUNDRIES

(71) Applicant: NEMAK, S.A.B. DE C.V., Garcia (MX)

(72) Inventors: German Gabriel Salas-Loranca, Garcia (MX); Oscar Gerardo Cantu-Gonzalez, Monterrey (MX)

(73) Assignee: NEMAK, S.A.B. DE C.V., Nuevo Leon, NM (US)

( * ) Notice: Subject to any disclaimer, the term of this patent is extended or adjusted under 35 U.S.C. 154(b) by 256 days.

(21) Appl. No.: 16/303,628

(22) PCT Filed: May 18, 2017

(86) PCT No.: PCT/IB2017/000673
§ 371 (c)(1),
(2) Date: Nov. 20, 2018

(87) PCT Pub. No.: WO2017/199091
PCT Pub. Date: Nov. 23, 2017

(65) Prior Publication Data

US 2020/0316675 A1 Oct. 8, 2020

Related U.S. Application Data

(60) Provisional application No. 62/339,798, filed on May 20, 2016.

(51) Int. Cl.
*B22C 25/00* (2006.01)
*B22C 9/10* (2006.01)
(Continued)

(52) U.S. Cl.
CPC ..... *B22C 9/02* (2013.01); *B22C 9/103* (2013.01); *B22C 9/108* (2013.01); *B22C 25/00* (2013.01); *B22C 23/00* (2013.01); *B22D 47/02* (2013.01)

(58) Field of Classification Search
CPC ..... B22D 47/00; B22D 47/02; B22C 11/04; B22C 9/10; B22C 9/103; B22C 9/108; B22C 25/00
See application file for complete search history.

(56) References Cited

U.S. PATENT DOCUMENTS 3,802,487 A 4/1974 Feller
6,725,903 B2 4/2004 Laurino
(Continued)

FOREIGN PATENT DOCUMENTS

DE 203 19 221 U1 4/2004
DE 102008037778 A1 * 2/2010 ..... B22D 27/04

OTHER PUBLICATIONS

International Search Report and Written Opinion dated Aug. 17, 2017 in corresponding International Application No. PCT/IB2017/000673.

*Primary Examiner* — Kevin E Yoon
(74) *Attorney, Agent, or Firm* — Haug Partners LLP

(57) ABSTRACT

A mold assembly cell for sand mold production comprising a turntable wherein sand cores and other mold parts (which together cooperate to define the casting cavity of the sand mold) are automatically and progressively assembled following a sequential pre-programmed schedule by programmable robots located in proximal relationship with the turntable and a core shooting machine. The assembly turntable rotates clockwise or counterclockwise to permit placement of progressively more-complete mold packages in each of at least three assembly stations to allow the robots to reach the molds being assembled at different angles for
(Continued)

simultaneously setting the sand cores and other parts of the mold according to said pre-programmed assembly schedule. Also a mold assembly line comprising a plurality of the foregoing assembly cells to form sand molds for casting complex-geometry aluminum parts, such as aluminum engine blocks and cylinder heads, with greater flexibility, efficiency and productivity.

4 Claims, 4 Drawing Sheets

(51) Int. Cl.

| | |
|---|---|
| ***B22C 9/02*** | (2006.01) |
| *B22C 23/00* | (2006.01) |
| *B22D 47/02* | (2006.01) |

(56) References Cited

U.S. PATENT DOCUMENTS

| | | | | |
|---|---|---|---|---|
| 6,920,909 | B2 | 7/2005 | Colon et al. | |
| 7,588,070 | B2 | 9/2009 | Smetan | |
| 2010/0224342 | A1* | 9/2010 | Kanayama ..... | B22D 47/00 164/326 |

* cited by examiner

AUTOMATED ASSEMBLY CELL AND ASSEMBLY LINE FOR PRODUCING SAND MOLDS FOR FOUNDRIES

FIELD OF THE INVENTION

The present invention relates to the field of foundries and casting operations, more particularly to methods and systems for assembling sand cores to form sand molds for casting complex-geometry aluminum parts, such as engine blocks and cylinder heads, with higher flexibility, efficiency and productivity than the currently used methods, tools and mold assembly lines.

BACKGROUND OF THE INVENTION

For high-volume casting of engine blocks and other automotive and aviation components of light metals such as aluminum, the widely used casting process in the automotive industry is the precision sand casting. The castings are formed into sand molds, usually resin-bonded. The sand mold defines the complex casting geometry by means of a set of sand cores which are sequentially assembled with high precision in a predefined sequence and form mold core packages. After casting, the mold is heated and the resin, that fixes the sand of the cores, is burned with a consequent loosening of the sand which is then extracted from the solidified casting, thus forming the designed intricate passages within the cast engine block. To efficiently form the mold package, it has to be assembled in a predefined sequence by industrial robots having access to the mold packages in an assembly line.

The sand mold packages for engine blocks comprise for example, a base core, a crank case core, left and right sides cores, front and rear cores, barrel slab cores and top cores; internal passages are made also with cores for example, main oil gallery core, oil drain cores, water jackets, etc. The currently used method for assembling core packages utilizes an assembly line with mechanical conveyors that move the sand molds through several assembly stations where the cores are positioned by operators and/or robots whereby said molds, also known as mold packages, are progressively built up. The robots are programmed for gripping the sand cores and putting them in their respective position according to the engine design, progressing from the incipient (i.e. still incomplete) mold package, to finally form the complete mold package.

The currently-used mold assembly lines based on use of conveyors present a number of disadvantages during formation of the mold package. For example, if one of the robots presents a failure, or the supply of one of the cores is delayed or interrupted, the whole assembly line stops. Since the cores assembling operation has a predetermined sequence there is no way to advance some of the incomplete packages to the next assembly stations by-passing the non-working station.

The layout of the conveyor-based assembly lines need a large area in the foundry and must produce only one mold design per product run without any flexibility for simultaneously assembling mold packages of different designs.

Another drawback of the conveyor-based assembly lines is that a large number of robots are required because the moving path of the mold packages is linear and so only two robots may be placed at each assembly station.

The present invention overcomes the above-mentioned disadvantages by providing a mold assembly cell where the molds are partially or fully formed, and a modular assembly line formed by a plurality of said assembly cells. The mold assembly cells comprise a turntable-like structure to support the bases where the cores are set by robots, for example Cartesian-type robots, which sequentially position and assemble the cores in a pre-programmed sequence. The assembly turntable is preferably shaped to hold three core packages to cyclically rotate clockwise or counterclockwise as required by the assembly program, positioning said mold packages in at least three assembly stations. The robots are located around the turntable structure so that they have access to the mold packages at pre-programmed angles and are enabled to reach the required points of the mold packages to set the cores and build the casting mold.

The assembly robots are provided with suitable grippers and manipulating tools to pick up the cores from an adjacent core inventory racks or pick-up table and release them in their exact position in the mold package. The invention provides simultaneous access of the robots to the core assembly and also to the core shooting machines, where the cores are made.

Normally, the cores are handled for their assembly in pairs, for example: left side and right side, front side and rear side, etc. Due to the capabilities of the turntable structure, e.g. rotation in both directions clockwise and counterclockwise and also for rotating each mold package about a respective vertical axis, and thus each mold package may be reached by all robots surrounding the turntable, the assembly cell provides unique advantages for easily changing the type of mold to be manufactured.

In another aspect of the invention, a plurality of assembly cells may be located in a cluster to form an assembly line which advantageously may manufacture several types of molds with different designs without interfering with the other cells and also providing flexibility for continuing assembly operations in case one of the assembly cells stops working for some mechanical failure or for requiring maintenance. The assembly cells cluster may be comprised from a plurality of assembly cells arranged in any desired layout, for example as a linear arrangement or circular or any other arrangement.

Applicants have found the following prior-art related to the invention: U.S. Pat. No. 3,802,487 discloses an apparatus for producing foundry molds using turntables wherein a machine with multiple work stations is used. This patent however does not use robots for automatically assembling complex geometry molds with simultaneous assistance of robots.

U.S. Pat. No. 6,725,903 describes an automated casting system where a robotic device cyclically moves a casting ladle to collect molten metal from a furnace and pour it out into a casting mold. In FIG. 3 of this patent a system comprising a turntable provided with four arms, each of which has a plate for housing the castings. The turntable is rotated 90° in each cycle. A robot is used for manipulating the castings but there is no teaching or suggestion in this patent about using a turntable with three or more work stations capable of simultaneously using a plurality of robots for assembling sand cores and produce mold packages.

U.S. Pat. No. 6,920,909 describes a core assembly apparatus which includes a rotating table with a plurality of fixtures for assembling cores. This patent however does not teach or suggest the use of robots for an automatic operation. The molds are assembled by an operator positioned at one of the work stations of the rotating table. This core assembling system does not provide the flexibility for simultaneously and automatically assembling several cores in the mold. This system does not provide the productivity of the invention wherein the robots surround a turntable shaped to better accommodate the robots with a unique layout and that permits the robots to operate simultaneously in several work stations.

U.S. Pat. No. 7,588,070 describes a production line and method for the production of cast parts in a continuous cycle comprising a core production unit which uses a conveyor forming a rectangle. Several assembly robots are located at the sides of the conveyor for taking over the cores and other robots for assembling them into the mold. The system of this patent has a number of disadvantages, such as requiring a large number of robots. Also, since the mold packages are assembled following a single linear path, there is no possibility of returning the molds to prior assembly positions, and there is no teaching or suggestion about arranging several assembly units to form a mold assembly line. This mold assembly unit does not provide the flexibility to continue assembly of the molds, even if the conveyor has to be shut down for any mechanical problem or for maintenance.

This application claims priority benefit from U.S. Provisional Application No. 62/339,798 filed May 20, 2017, the specification and drawings of which are incorporated by reference herein in their entirety.

OBJECTS OF THE INVENTION

It is therefore an object of the invention to provide an apparatus and method for manufacturing sand mold packages for casting complex-geometry castings with higher efficiency and lower capital and operating costs.

It is another object of the invention to provide a sand core mold package assembly cell for foundries with higher flexibility which can be used for any design of the casting piece with lower setting up costs and time.

Other objects of the invention will be evident to those skilled in the art or will be pointed out in connection with the description of some preferred embodiments of the invention.

SUMMARY OF THE INVENTION

The objects of the invention are generally achieved by providing a mold package assembly cell comprising a turntable having at least three work spots for holding sand core packages being assembled and at least one robot that places sand cores in a pre-programmed sequence in the corresponding positions in said mold package; characterized by said turntable being capable of rotating about a central axis to position said mold package at different stages of assembly in at least three assembly stations and having at least one robot for manipulating the sand cores and setting said sand cores in their defined places within the mold package. The rotating table has such a shape including at least one recess around its periphery to allow said at least one robot to reach the locations in the mold package where the cores are set to build said mold package. For added flexibility regarding the programmed sequence of setting cores, the rotary table may rotate both clockwise and counterclockwise. In another aspect of the invention, a plurality of mold package assembly cells form an assembly line providing synergistic advantages to produce mold packages of different design and/or to increase the productivity of a mold package manufacturing operation by passing partially assembled mold packages from one cell to another cell of the line when a cell presents operational problems or is shut down for maintenance.

DETAILED DESCRIPTION OF THE INVENTION

Manufacturing of sand mold packages for mass production of automotive or aviation light-metal cast parts of complex geometry, such as engine blocks and heads, under the constraints of high productivity and precision requires the coordination of machine tools and human operators to produce the multiple cores forming the mold cavity for casting said parts.

The advantages of the invention will be described with reference to an exemplary embodiment of the invention for formation of an engine block mold, illustrated in the attached FIGS. 1 to 4, where the same numerals are used in the different figures to designate the same or similar elements for easier reading and understanding of the principles of the invention.

Figure 1:
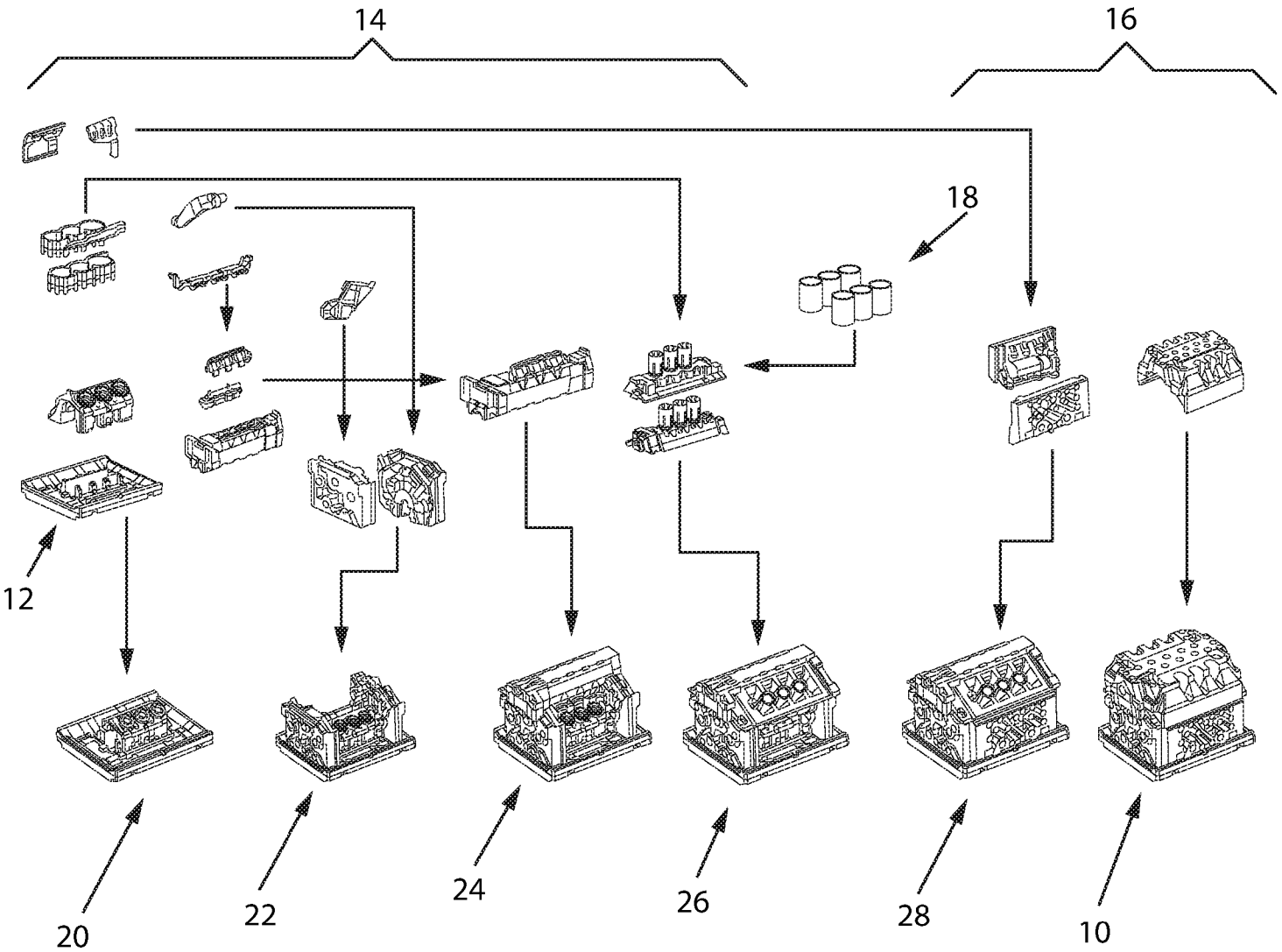
FIG. 1 diagrammatically illustrates one exemplary sequence of core assembly to produce a mold package for casting an engine block.

Referring to FIG. 1, a finished mold package 10 ready for casting an engine block is formed by sequentially assembling the cores and components of the casting progressively starting from a core base 12 where the variety of sand cores 14 and 16 and metal cylinder liners 18 are set in their position progressively forming sub-assemblies 20, 22, 24, 26 and 28 until finally the complete mold package 10 is formed and filled with molten metal.

By way of example, the mold assembly starts with core base 12 and in some designs some of the sand cores are placed in pairs, e.g. front/rear slabs, liners, cylinder barrels, etc. for an efficient and fast mold assembly for high productivity of the mold assembly system, it is desirable that at least two robots have access to the core base and to be able to simultaneously place two or more cores in the single assembly position.

Sand cores are held by suitable gripping mechanisms from a core shooting machine 82 or from a core rack and are delivered by programmed robots, usually in pairs, to be assembled onto the incipient mold packages on the previously delivered and set cores; so that with each next assembly step, the mold package is sequentially being formed as shown in views 22, 24, 26, & 28 at one or more additional assembly stations and finally results in the completed mold package 10 ready to be filled with molten metal.

Figure 2:
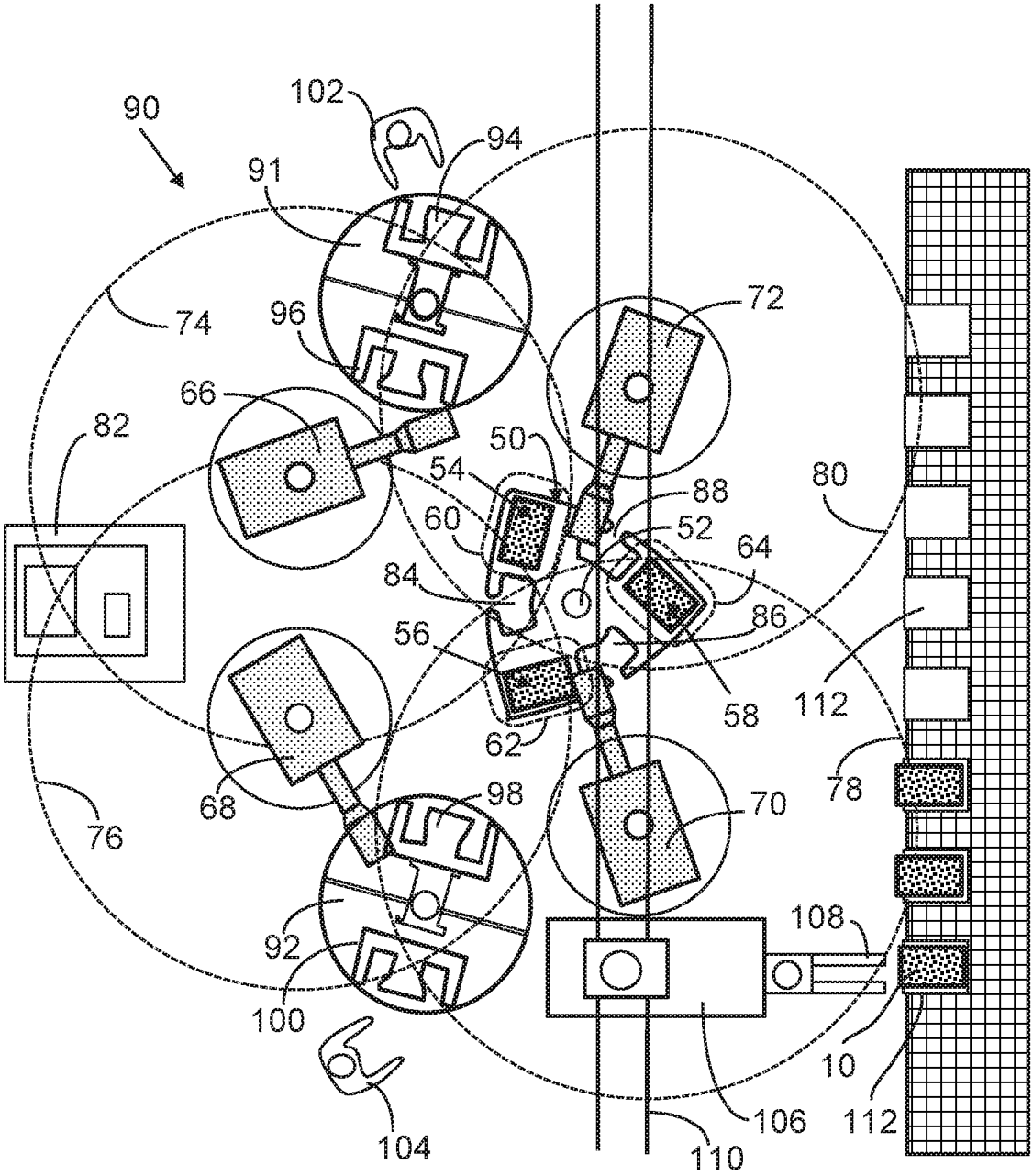
FIG. 2 is a diagrammatic plan view of one aspect of the invention showing the components and the layout of a sand core assembly cell, as well as the advantages of the invention regarding the multiple programmed assembly operations to form a casting mold package.
Figure 3:
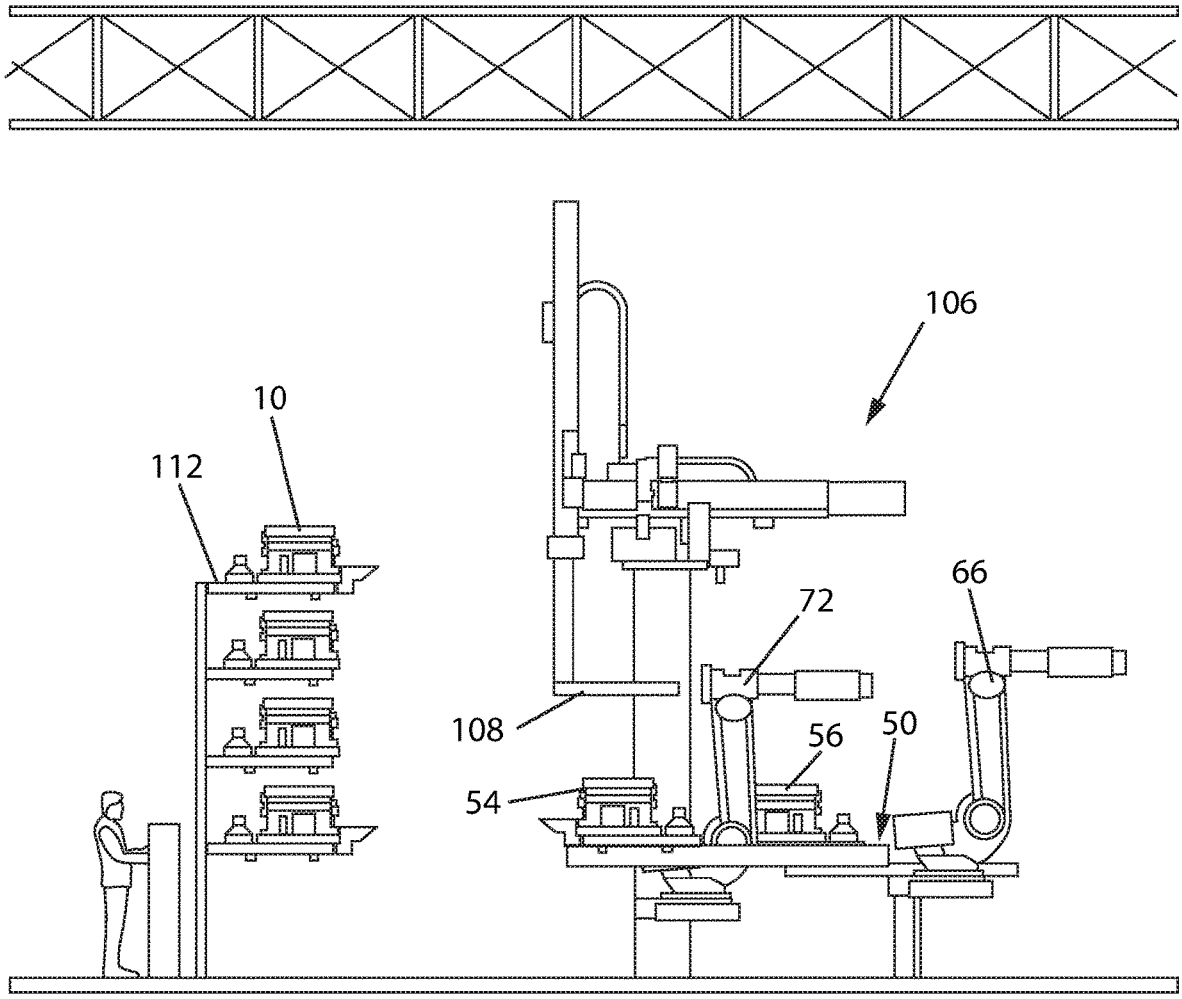
FIG. 3 is a diagrammatic side view of a mold assembly cell shown in FIG. 2.

FIGS. 2 and 3, show a schematic plan and a side view of a mold assembly cell 90 designed and operating according to one exemplary and non-limiting embodiment of the invention. The mold assembly cell 90 comprises a turntable 50 which positions the incipient mold packages at three or more assembly stations for sequentially receiving sand cores and other components of the mold to build up said mold. The assembly stations 60, 62, & 64 are arranged along a circular path within said assembly cell 90, within close proximity and within reachable distance by a plurality of robots. In an exemplary embodiment of the invention in the cell 90 shown in FIG. 2, the assembly of the mold package is built up from the core base 12. This build up by the sequential addition of other cores and components are indicated by numerals 54, 56, &58, which represent the incipient mold packages including the core bases and/or mold packages at different stages of assembly and/or finished molds. These are placed on a turntable 50 having at least three cyclical assembly positions 60, 62 & 64 and having a suitable shape for allowing the assembly robots 66, 68, 70, & 72 to simultaneously move around the turntable and set sand cores in said three core bases to build up the mold packages. After setting the cores at each assembly position corresponding to the pre-programmed sequence of assembly, the turntable rotates 120° and the next cores are assembled in the new assembly position of the turntable 50.

The mold package holding devices 60, 62, & 64 located on the turntable 50 are capable of rotation with the turntable around its vertical shaft 52 that is substantially perpendicular to the surface of said turntable. This capability increases the flexibility of the mold assembly cell because the mold package may be rotated around its respective axis and in this way may be positioned within reachable distance of a programmed robot.

To increase the programming flexibility of the mold_assembly cell to produce different molds having a variable number of cores and components, the turntable 50 may be rotated clockwise or counter-clockwise depending on the programmed core assembly sequence, so that a predetermined mold package is positioned within reach of the robots at the programmed sequential assembly step.

A plurality of assembly robots 66, 68, 70, & 72, having circular reaching areas 74, 76, 78, & and 80, shown with dotted lines, are installed around turntable 50 for handling and positioning sand cores from the core forming machine 82 to at least one of the assembly stations 60, 62, & and 64 and for picking up cores and components for the incipient mold package from core-shooting machine 82 to any of said assembly stations.

The resin-bonded sand cores may be produced using any conventional core-making process such as a phenolic urethane cold box or furane hot box by blowing sand and binder into a core-forming box where it is cured with either a catalyst gas or heat. The foundry sand can include silica, zircon and other materials as desired.

Robots 66 and 68 are preferably symmetrically positioned in the mold assembly cell with respect to the operating positions 60, 62, & 64 of turntable 50 so that the robots can access the front part and the rear part of the incipient sand mold packages 54, 56 and/or 58, located in the assembly stations 60, 62 or 64 and the sides of the mold packages in another assembly station.

The assembly turntable 50 in the illustrated embodiment has a plurality of cuts 84, 86 and 88 in its periphery to facilitate access of the robots to the mold packages as needed for reaching all positions of cores at the programmed angles.

In an exemplary embodiment of the invention, the mold assembly cell comprises four robots 66, 68, 70, & 72. These robots are positioned symmetrically with respect to the tips of the triangularly shaped turntable 50 with circular reaching areas indicated by dotted lines 74, 76, 78, & 80.

The mold assembly cell may also comprise other auxiliary turntables 90 and 92 which are used to prepare and supply sand cores or other mold components to be used in turntable 50. To this end, these auxiliary turntables 90 and 92 are provided with holding means 94, 96, 98, & 100. Operators 102 and 104 may use these auxiliary turntables 90 and 92 for inspecting and preparing sand cores and mold components and release them to the position where the robots may manipulate them according to the mold assembly schedule.

During the operation of the assembly cell, for example, robots 66 and 72 may have access to the incipient mold package 54 located in the assembly station 60 and other robots 68 and 70 may have access to incipient mold packages 56 while robots 70 and 72 may have access to the incipient mold package 58. Turntable positions 60 and 62 may function also as core loading positions with respect to assembly turntable 50 and position 64 may also function as an unloading position from which the completed sand mold package can be conveyed to the next stage in the casting process, normally the metal filling of the sand mold to produce the casting.

Figure 4:
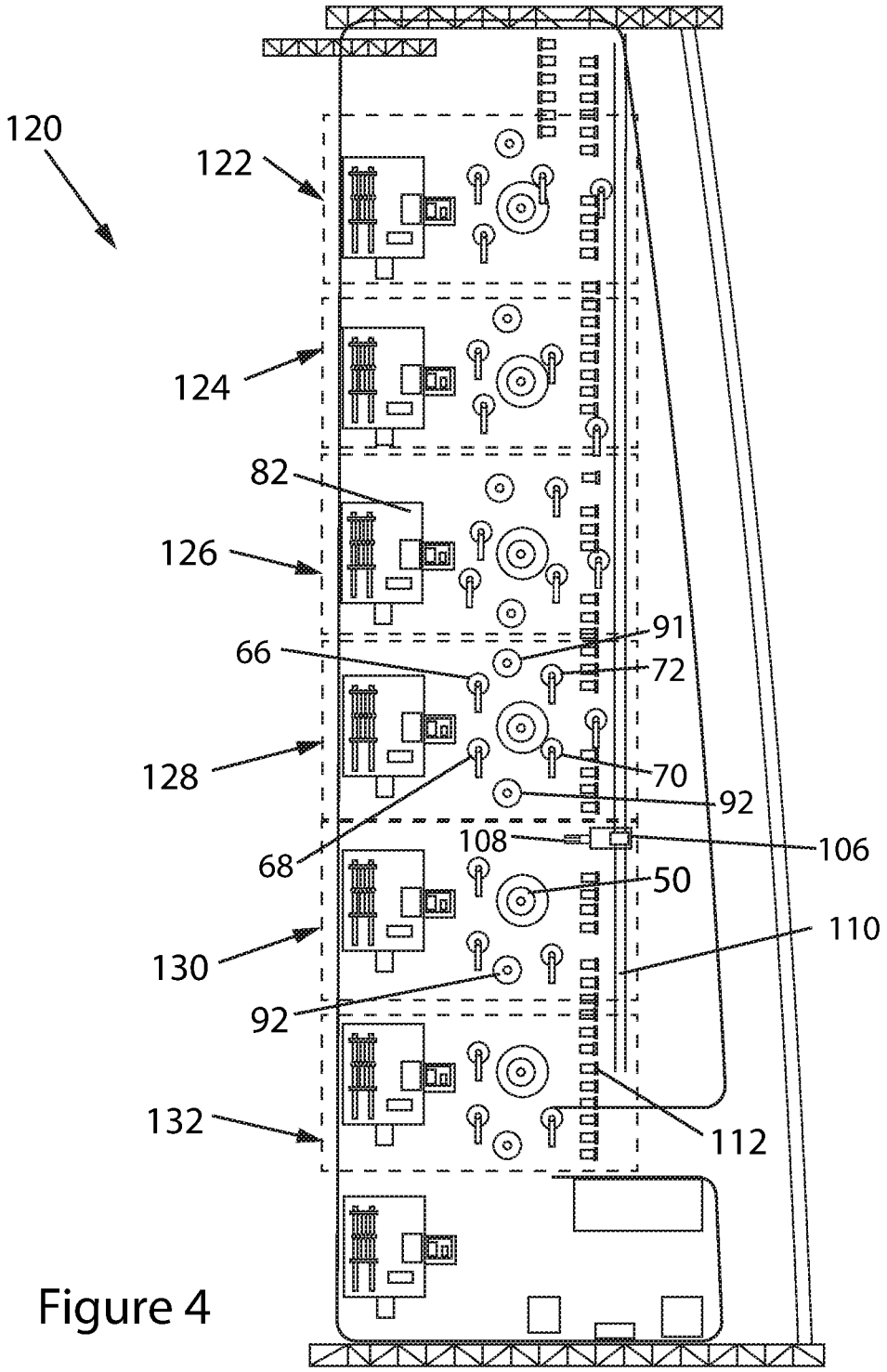
FIG. 4 is a diagrammatic plant view of a second aspect of the invention showing a mold assembly line formed by a plurality of the inventive assembly cells.

One or more gantry-type device 106 are provided, each with suitable grippers or lifting fixtures 108 for holding the sand core mold package while being run along an overhead rail 110 back and forth to convey the sand mold packages to a storing rack 112 as shown in FIG. 2, or to at least another assembly cell of a plurality of assembly cells forming an assembly line 120 as shown in FIG. 4, or to the metal pouring section of the foundry.

The robots are positioned in a symmetrical angle to access the front or rear in one operating position and the sides of the mold packages. The angle of attack for the next assembly task in sequence can be selected by changing the direction of rotation of the turntable 50 from clockwise to counter-clockwise direction and by positioning the mold package in one of two possible angles in the assembly station.

The layout of the assembly robots with respect to the operating positions of the assembly turntable 50 permits that the core assembling operation can be realized with the same cell equipment and tools independently of the specific design and the number of sand cores to be assembled for any casting product.

This novel combination of a rotating assembly turntable having three operating positions and the robots surrounding the turntable allows the production of sand core mold packages having any possible combination of sequence for the assembly process, avoiding the lengthy and costly set-up of specific sand core assembly stations for each specific engine block design as currently needed in foundries.

The assembly cell of the invention provides a number of advantages for foundries and overcomes many drawbacks of the currently used systems used for sand mold packages forming.

Referring to FIG. 3, a diagrammatic side view of a mold package assembly cell is shown comprising turntable 50 with mold packages 54 and 56 being assembled by robots 66 and 72 (only two shown for simplicity of the drawing) and a gantry robot 106 is used for picking up the at least partially finished mold packages 10 and placing them in rack 112.

In another aspect of the invention a sand mold assembly line is laid out by arranging a plurality of mold assembly cells in clusters which can be linear, circular or of any shape that best fits the space available for the mold manufacturing line.

Referring to FIG. 4, a mold assembly line 120 is formed by a plurality of mold assembly cells 122, 124, 126, 128, 130, &132, clustered in a linear arrangement. The novel mold assembly line provides advantages in flexibility and productivity over the currently mold assembly lines which utilize conveyors through a series of assembly stations.

See for example in FIG. 4, that cell 128 is similar to the assembly cell shown in FIG. 2, but that other cells such as cell 130 have different operations requiring fewer robots.

The mold assembly line 120 has a significantly higher productivity because if one of the mold assembly cells needs to be re-tooled or re-programmed or requires to be shut-down for maintenance activities, the rest of the assembly cells may continue assembling the mold packages. This flexibility is not possible in a conveyor-based mold assembly line.

It will be understood that the above description has been made for purposes of illustration as referred to the casting of aluminum engine blocks, but that the invention can be used with advantages for manufacturing sand molds for casting other light-metal products.

What is claimed is:

1. A mold assembly cell for preparing a mold for metal casting, from sand cores and other mold components, comprising a turntable which is structured to be cyclically positionable to at least three mold assembly stations; programmable turntable robots in at least one of said assembly stations for progressively assembling said mold by securing a plurality of sand cores and/or other components of said mold to an incipient mold package and wherein said assembly stations are arranged along a circular path within said assembly cell, within close proximity to and within reaching distance of said robots, said turntable being capable of rotating in a clockwise or counter clockwise direction, wherein said turntable having cutouts towards the center of said turntable, said programmable turntable robots being positioned for handling and positioning said sand cores and/or other mold components into said incipient mold package in a predetermined assembly sequence, at said assembly stations; and means for withdrawing said incipient or complete mold package from said assembly cell for continuing its assembly in another assembly cell or for its further processing or for carrying out said metal casting.

2. A mold assembly cell according to claim 1, further characterized by said turntable comprising a surface rotatable about a vertical shaft for stopping the rotation in three operational positions at said assembly stations, where the surrounding robots are positioned to set the sand cores and/or other mold components in the incipient mold package being assembled.

3. A mold assembly cell according to claim 1 further characterized by said turntable having a generally triangular shape.

4. A mold assembly cell according to claim 3 further characterized by said cutouts being formed on the sides of the triangular shape of the turntable to facilitate access of the robots or of operators to the incipient mold packages.

* * * * *